US012291879B2

(12) United States Patent
Moller, Jr. et al.

(10) Patent No.: US 12,291,879 B2
(45) Date of Patent: May 6, 2025

(54) METHOD AND APPARATUS FOR ASSEMBLING A FLOOR PANEL

(71) Applicant: SNAP LOCK INDUSTRIES, INC., Salt Lake City, UT (US)

(72) Inventors: Jorgen J Moller, Jr., Sandy, UT (US); Jeremiah D. Shapiro, Layton, UT (US)

(73) Assignee: Snap Lock Industries, Inc., Salt Lake City, UT (US)

( * ) Notice: Subject to any disclaimer, the term of this patent is extended or adjusted under 35 U.S.C. 154(b) by 514 days.

(21) Appl. No.: 17/564,591

(22) Filed: Dec. 29, 2021

(65) Prior Publication Data

US 2023/0203824 A1 Jun. 29, 2023

(51) Int. Cl.

| | |
|---|---|
| ***E04F 21/22*** | (2006.01) |
| ***E04F 15/02*** | (2006.01) |
| ***E04F 15/10*** | (2006.01) |

(52) U.S. Cl.

CPC ..... *E04F 21/22* (2013.01); *E04F 15/02022* (2013.01); *E04F 15/02038* (2013.01); *E04F 15/0215* (2013.01); *E04F 15/107* (2013.01); *E04F 2201/0115* (2013.01)

(58) Field of Classification Search

CPC ..... E04F 21/22; E04F 15/02022; E04F 15/02038; E04F 15/0215; E04F 15/107; E04F 2201/0115; B30B 15/30; B30B 9/28; B32B 38/1833

See application file for complete search history.

(56) References Cited

U.S. PATENT DOCUMENTS

| | | | | |
|---|---|---|---|---|
| 6,491,775 | B1 * | 12/2002 | Janssen | B29C 63/0004 269/319 |
| 8,892,244 | B1 * | 11/2014 | Taylor | F41H 5/0492 700/218 |
| 2008/0072514 | A1 * | 3/2008 | Barlow | E01C 5/22 52/540 |
| 2015/0336272 | A1 * | 11/2015 | Drew | E04F 21/1872 414/737 |
| 2022/0297404 | A1 * | 9/2022 | Giannazzo | B30B 9/28 |

FOREIGN PATENT DOCUMENTS

CN 205317120 U * 6/2016

OTHER PUBLICATIONS

CN205317120U Machine Translation of Description (Year: 2024).*

* cited by examiner

*Primary Examiner* — Cynthia L Schaller
(74) *Attorney, Agent, or Firm* — DORSEY & WHITNEY LLP

(57) ABSTRACT

An assembly apparatus for assembling a floor panel can include a platform to support a base layer and a top layer of the floor panel. The platform can include a first wall configured to contact a first edge of the base layer and a first edge of the top layer. The platform can further include second wall adjacent to the first wall and configured to contact a second edge of the base layer and a second edge of the top layer. A sensor unit can determine whether the first edge of the base layer is aligned with the first edge of the top layer, and whether the second edge of the base layer is aligned with the second edge of the top layer.

20 Claims, 6 Drawing Sheets

METHOD AND APPARATUS FOR ASSEMBLING A FLOOR PANEL

TECHNICAL FIELD

The described embodiments relate generally to the assembly of floor tiles. More particularly, the present embodiments relate to an assembly apparatus for repeatedly and accurately assembling floor tiles.

BACKGROUND

Floor tiles are used for a variety of purposes, including utilitarian and aesthetic purposes. Floor tiles are often used in industrial and manufacturing settings. For example, floor tiles can be used as a support surface in a workspace or to protect the surface beneath the tiles from various forms of damage. Floor tiles can also be used to accentuate an object displayed on top of the tiles. Floor tiles typically comprise individual modular tiles that are placed on the ground either permanently or temporarily depending on the application. A permanent application may or may not involve adhering the tiles to the floor in some way, whereas a temporary application may simply involve setting the tiles on the floor. Floor tiles are often horizontally interconnected to one another to cover large floor areas such as a garage, display areas or work space. Further floor tiles often include multiple layers that are attached during the manufacturing process. For example, a completed floor panel may include a base layer forming an underside of the panel, and a top layer, forming the upper surface of the panel.

Traditionally, setting a top layer onto a base layer was done manually and alignment of the layers was performed by an operator merely looking at the layers to eyeball the alignment. Not only was this process placement labor and time intensive, manual placement and alignment often required multiple attempts to properly align the top and base layers. This type of manual placement often required at least two people. Further, as floor panels become larger, the challenges of manual alignment and placement increase. Accordingly, it is desirable to produce a system that can reliably and accurately align layers to form a multi-layered panel.

SUMMARY

According to an aspect of the present disclosure, an assembly apparatus to assemble a floor panel can include a platform that can support a base layer and a top layer of the floor panel. The platform can include a first wall that can contact a first edge of the base layer and a first edge of the top layer, and a second wall, adjacent to the first wall, that can contact a second edge of the base layer and a second edge of the top layer. The assembly apparatus can include a sensor unit that can determine whether the first edge of the base layer is aligned with the first edge of the top layer, and whether the second edge of the base layer is aligned with the second edge of the top layer.

In some examples, the assembly apparatus can include a transfer mechanism that can move the top layer. The transfer mechanism can include a retention feature that can releasably secure the top layer to the transfer mechanism. The transfer mechanism can include an articulating vacuum arm. The retention feature can include a plurality of suctioning couplers. The transfer mechanism can perform an action in response to a determination of the sensor.

In some examples, each of the first wall and the second wall can include a plurality of guides that extend from the wall, the guides can contact and guide the top layer onto the base layer. The first wall and the second wall can define a plurality of recesses that receive protrusions extending from the first edge and the second edge of the base, respectively. The assembly apparatus can include a third wall that can contact a third edge of the base. The third wall can define a plurality of recesses that can receive protrusions on the third edge.

In some examples, the assembly apparatus can include a fourth wall that can contact a fourth edge of the base. The fourth wall can define a plurality of recesses to receive protrusions on the fourth edge. The sensor unit can include a visual indicator that can signal to an operator an alignment of the top layer relative to the base. The sensor unit can include one or more laser sensors. The sensor unit can include a first pressure sensor on the first wall. The first pressure sensor can detect contact between the first wall and the first edge of the top layer. The sensor unit can include a second pressure sensor on the second wall. The second pressure sensor can detect contact between the second wall and the second edge of the top layer.

According to some aspects, a method for assembling a tile can include positioning a first edge of a base layer against a first wall, positioning a second edge of the base layer against a second wall, the second edge being adjacent to the first edge, positioning a first side of a top layer against the first wall, positioning a second side of the top layer against the second wall, the second side being adjacent to the second side, and placing the top layer onto the base layer.

In some examples, the method can include forming the base layer from multiple interlocking base tiles. The method can include depositing an adhesive on at least one of the base layer and the top layer. The method can include compressing the top layer to the base layer. The method can include restricting placement of the top layer on the base layer in response to determining that the top layer is not aligned with the base layer.

According to some aspects, a system for assembling a floor panel can include an articulating arm, a coupler attached to an end of the articulating arm, the coupler can releaseably couple to a top layer, a wall that can position a base layer in a predetermined location, and a guide extending from the wall, the guide can position the top layer in a predetermined location above the base layer.

In some examples, the wall is a first wall that can contact a first edge of the base layer, and the guide is a first guide that can contact a first edge of a top layer. The system can further include a second wall adjacent to the first wall that can contact a second edge of the base layer. The system can include a second guide extending from the second wall. The second guide can contact a second edge of the top layer.

In some examples, the system can include a sensor unit that can determine whether the first edge of the base layer is aligned with the first edge of the top layer, and whether the second edge of the base layer is aligned with the second edge of the top layer. A function of the articulating arm can be restricted based on a position of the top layer relative to the base layer.

The foregoing and other features, utilities, and advantages of the invention will be apparent from the following detailed description of the invention with reference to the accompanying drawings.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION OF THE INVENTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The present disclosure relates generally to floor panel. As used herein, a "panel" or "floor panel" refers to the completed section of flooring or floor covering that is ready to be placed or installed on the ground or a floor surface. As described in greater detail below, an assembled panel can include multiple layers and even multiple sections or modular tiles. In other words, the floor panel can include a base layer or substrate and a top, cosmetic layer. The floor panels can be configured for use in a wide variety of areas, including recreation areas, dance halls, manufacturing plants, production lines, assembly lines, residential homes, business, and other locations. The floor panels can be intended to support humans, vehicles, equipment, storage racks, machinery, and other types of items.

Floor panels can include multi-layered assemblies that require time and effort to assemble. A major challenge is assembling multi-layered floor tiles is ensuring that the layers are properly aligned. Accordingly, it is desirable to produce a method and apparatus that enables accurate and repeatable assembly of multi-layered floor panels.

These and other examples are discussed below with reference to FIGS. 1-5. However, a person of ordinary skill in the art will readily appreciate that the detailed description given herein with respect to these figures is for explanatory purposes only and should not be construed as limiting.

Figure 1:
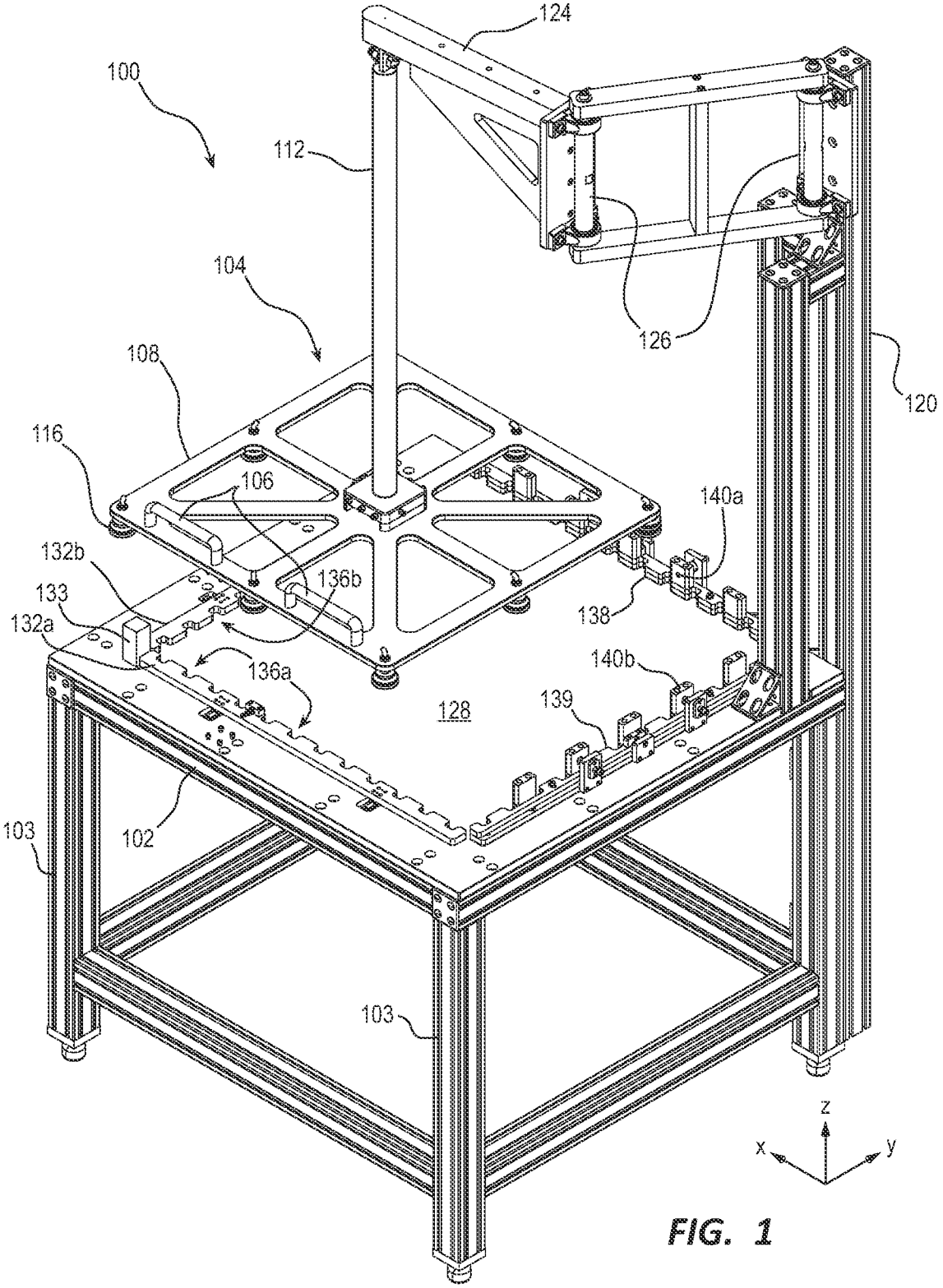
FIG. 1 shows a perspective view of a device for assembling a floor panel.

FIG. 1 shows a perspective view of an assembly apparatus 100 used to assembly multi-layered floor panels. The assembly apparatus 100 can include a platform 102 supported by one or more legs 103. The platform 102 can be substantially horizontal to (i.e., parallel with) the floor.

The assembly apparatus 100 can include a support arm 104. The support arm can be a transfer mechanism configured to transport one or more layers of the multi-layered panel. The support arm 104 can include a swing arm 124 that pivots or rotates about one or more hinges 126. The support arm 104 can extend above the platform 102 from a post 120. The support arm 104 can include a retention feature 108 that is attached to the swing arm 124 by a hose 112. The retention feature 108 can include one or more couplers 116 that are configured to directly attach, secure, or couple to one or more layers of the floor panel. In some examples, the couplers 116 include suction cups capable of suctioning to a surface by applying a vacuum through the couplers 116. The hose 112 can be in fluid communication with a vacuum pump (not shown). In some examples, the couplers 116 can include any suitable mechanical or magnetic attachment mechanisms capable of grabbing, holding, or otherwise retaining one or more layers of the panel.

In some examples, the retention feature 108 can approximate the size and shape of the panel. The retention feature 108 can be a variety of shapes and configurations while still accomplishing the purpose of transporting panel layers. As discussed in greater detail below, the panel can be made from several base tiles. Accordingly, in some examples, the retention feature 108 can be designed specifically to efficiently lift and transport each section of a multi-based panel. In the embodiment where the base includes four tiles, the retentions feature 108 can be configured to apply a retention force evenly among each of the base tiles. For example, the couplers 116 can be symmetrically spaced to support each corner of the panel. The couplers 116 can further be positioned to avoid any sag or flex in the top layer or panel when being transported by the support arm 104. In some examples, the primary purpose of the support arm 104 is to transport a top layer of the panel. Upon reading this disclosure, those of ordinary skill in the art will understand that the base can include more than four tiles or any other suitable number of tiles depending on to the specific size and configuration of the panel being created.

The support arm 104 can be movable about several axis and planes. For example, the support arm 104 can move horizontally, along the x-axis and y-axis, and vertically, along the z-axis. In some examples, the support arm 104 can rotate about one or more axis. The support arm 104 can be manually or automatically (i.e., robotically) articulated. In some examples, an operator can physically or manually move the support arm. The retention feature 108 can include one or more handles 106 that the operator can manipulate to reposition the support arm 104. In some examples, the support arm 104 can be robotically controlled by an operator using any suitable controller.

In some examples, the assembly apparatus 100 can include an input member that controls the operation of the couplers 116. The input member can actuate (i.e., turn on/off) the vacuum supplied to the couplers 116. In an example operation, an operator of the assembly apparatus 100 can actuate the input member to suction a layer and/or to release the layer as needed.

The platform 102 can define a surface 128 that is intended to receive a base layer of the panel. The base layer can be placed on the surface 128. The platform 102 can include several walls, guides, or stops that help to define the surface 128 in which the base layer is set. For example, the platform 102 can include a first wall 138 and a second wall 139. The first wall 138 can be adjacent to the second wall 139. In some examples, the first wall 138 is perpendicular to the second wall 139, forming a right angle. The first wall 138 and the second wall 139 can be substantially similar. For example, each of the first wall 138 and the second wall 139 can include guides 140*a* and 140*b*, respectively. The guides 140*a*, 140*b* can extend upward from the first wall 138 and the second wall 139, respectively. The guides 140*a*, 140*b* can extend taller than a thickness or height of the assembled panel. The extended height of the guides 140*a*, 140*b* allows the top layer to come into contact with and be guided by the guides 140*a*, 140*b* before the layer is lowered onto the surface 128 or comes into contact with the base layer. Thus, the guides 140*a*, 140*b* can ensure that the top layer is correctly aligned before lowering the layer into place on the bottom layer.

The platform 102 can include a third wall 132*a* positioned adjacent to the second wall 139. The third wall 132*a* can be perpendicular to the second wall 139 and parallel to the first wall 138. The third wall 132*a* can be substantially similar to the first wall 138 and second wall 139, with the exception that the third wall 132*a* may not include guides, such as the guides 140*a*, 140*b*, extending from the third wall 132*a*. However, the present disclosure contemplates that the third wall 132*a* could include guides, such as guides 140*a*, 140*b*, extending upward from the third wall 132*a*. The third wall 132*a* can define a plurality of recesses 136*a* configured to receive protrusions of the base layer. By receiving the protrusions of the base layer, and edge of the base layer can be flush with the third wall 132*a*. The first wall 138 and second wall 139 can have similar recesses to accommodate for projections from the base layer.

In some examples, the third wall 132*a* can slide or move toward the first wall 138 in order to secure the base layer on the surface 128. A clamp or lock can releasably secure the third wall 132*a* in position. The third wall 132*a* can move or slide away from the first wall 138 to release the base layer. When the third wall 132*a* is positioned inward (i.e., toward the first wall 138), a footprint or area of the surface 128 can be substantially similar to that of the base layer. When the third wall 132*a* is positioned outward (i.e., away from the first wall 138) a footprint or area of the surface 128 can be larger than that of the base layer.

The platform 102 can include a fourth wall 132*b* positioned adjacent to the first wall 138 and the third wall 132*a*. The fourth wall 132*b* can be perpendicular to the first wall 138 and parallel to the second wall 139. The fourth wall 132*b* can be substantially similar to the third wall 132*a*. While not shown in the drawings, the present disclosure contemplates that the fourth wall 132*b* can include guides, such as guides 140*a*, 140*b* extending upward from the fourth wall 132*b*. The fourth wall 132*b* can define a plurality of recesses 136*b* configured to receive protrusions of the base layer. By receiving the protrusions of the base layer, an edge of the base layer can be flush with the fourth wall 132*b*. In some examples, the fourth wall 132*b* can slide or move toward the second wall 139 in order to secure the base layer on the surface 128. A clamp or lock can releasable secure the fourth wall 132*b* in position. The fourth wall 132*b* can move or slide away from the second wall 139 to release the base layer. When the fourth wall 132*b* is positioned inward (i.e., toward the second wall 139), a footprint or area of the surface 128 can be substantially similar to that of the base layer. When the fourth wall 132*b* is positioned outward (i.e., away from the second wall 139) a footprint or area of the surface 128 can be larger than that of the base layer.

In some examples, the assembly apparatus 100 can include an optical guide unit 133. The optical guide unit 133 can produce one or more optical features, such as laser lines, that are intended to guide an operator of the assembly apparatus 100. The optical guide unit 133 can emit an optical marker incident on the platform 102. In one example, the optical guide unit can emit one or more laser lines adjacent to and parallel with one or more of the walls 132*a*, 132*b*, 138, and 139. The operator can then adjust the position of support arm 104 until the top layer is position adjacent to the laser line. In some examples, the optical guide unit 133 produces one or more indicators that correspond to one or more markers or features of the top layer. For example, the optical guide unit 133 can emit one or more features that correspond to corners of the top layer.

The optical guide unit 133 can be positioned on the platform 102. The optical guide unit 133 can be positioned on or incorporated into one or more of the walls 132*a*, 132*b*, 138, and 139. In some examples, the optical guide unit 133 can be positioned on the post 120. In some examples, multiple optical guide units are used. Additional detail regarding guiding sensors and discussed below with reference to FIG. 4.

Figure 2A:
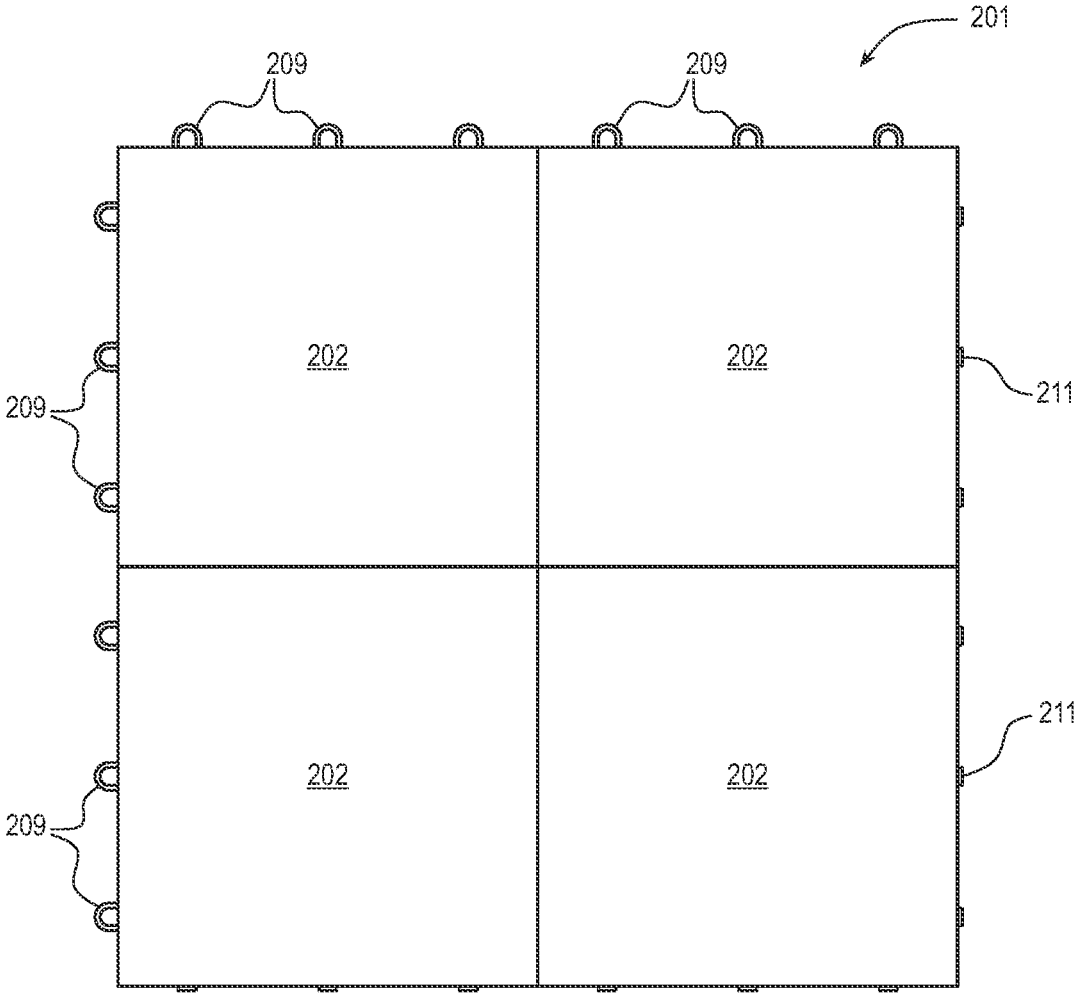
FIG. 2A shows a top view of a base layer.

FIG. 2A shows a top view of a base layer 201 of a floor panel. The base layer 201 can serve as a bottom or support layer for a floor panel. A top surface of the base layer 201 (visible in FIG. 2A) can be configured to contact a top layer. A bottom surface of the base layer 201, opposite the top surface, can be configured to contact the ground or floor.

In some examples, the base layer 201 is formed from several smaller base tiles 202. The base tiles 202 can attach to one another to form the base layer 201. Each base tile 202 can include a number of edges configured to abut corresponding edges on the corresponding tiles. In some examples, the edges can be substantially straight. Each edge can include one or more tabbed portions 211 and one or more receiving portions 209. The receiving portions 209 can include female engagement mechanisms configured to receive and couple with the tabbed portions 211. For example, the tabbed portions 211 can include protrusions configured to be received into the female portions 209. In some aspects, there can be multiple tabbed portions 211 and/or receiving portions 209 along each edge of the base tiles 202. The tabbed portions 211 can be configured to interlock with the receiving portions 209. The present disclosure contemplates any suitable engagement mechanism to connect the base tiles 202.

Figure 2B:
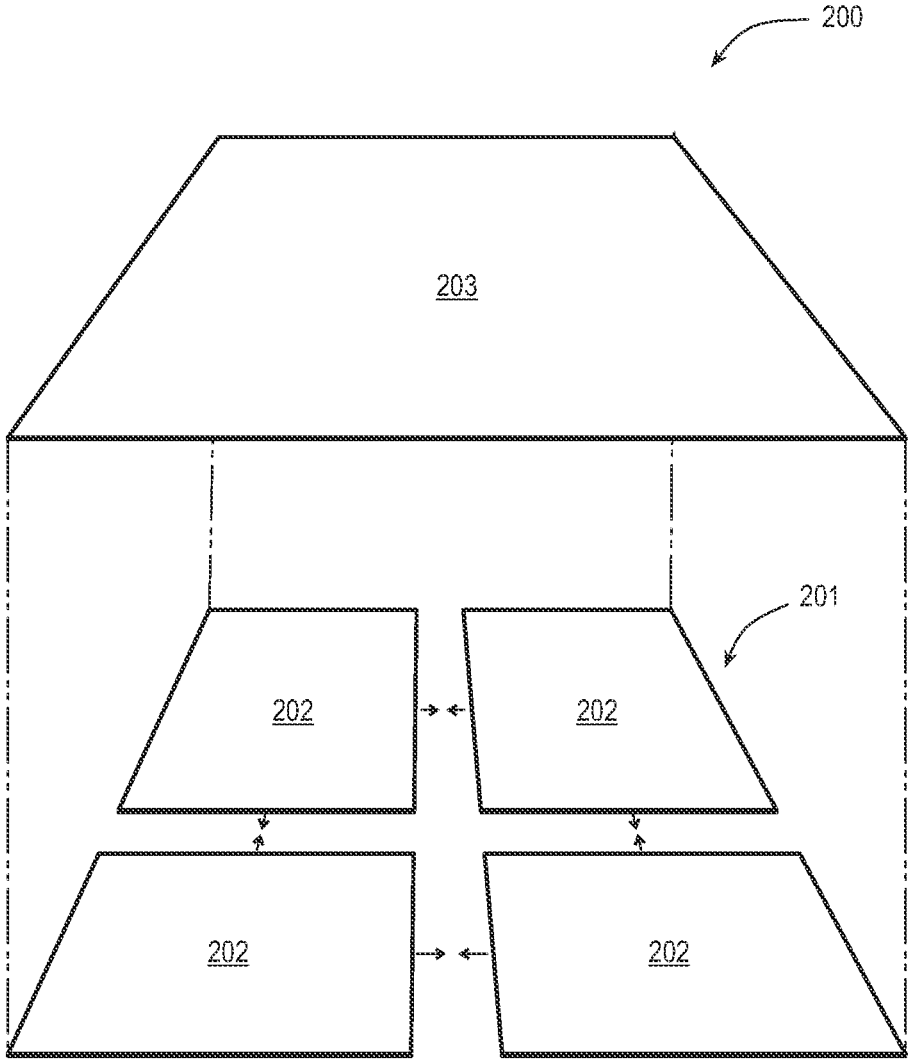
FIG. 2B shows an exploded perspective view of a floor panel.

FIG. 2B shows an exploded perspective view of a floor panel 200. In some examples, the floor panel 200 includes a base layer 201 (which can include four base tiles 202 or any other suitable number and configuration as required by the surface to be covered) and a top layer 203.

The top layer 203 can include a laminate or vinyl cover. The top layer 203 can include a cosmetic finish and can include damages resistance material suitable for the type of traffic expected on the top layer 203. In some examples, the top layer 203 can be thinner than the base layer 201. In some examples, the dimensions of the top layer 203 are identical to the base layer 201 when the base tiles 202 have been interlocked. In some examples, an upper surface of the top layer 203 is different than a bottom surface of the top layer. For example, the upper surface can include a finished surface, while the bottom surface can be rough or unfinished as it will not be visible in the assembled panel. In some examples, the top layer 203 can be approximately 36×36 inches, but can also be of any suitable dimension as required by the particular area of floor being covered by the assembled panel.

The base layer 203 can be formed from several base tiles 202 that can include modular interlocking sections. The base tiles 202 can be manufactured using an injection molding process. The base tiles 202 can be made from durable rubber or polymer compounds that can be rigid and/or flexible. In some examples, the base tiles 202 can be made from specialized rubber compounds for general purpose applications, resistance to industrial oils, ESD static dissipative and fire retardant applications. In some examples, the base tiles 202 are generally rigid while comprising one or more flex points or axis about which the base tiles 202 can bend or flex.

Figure 3:
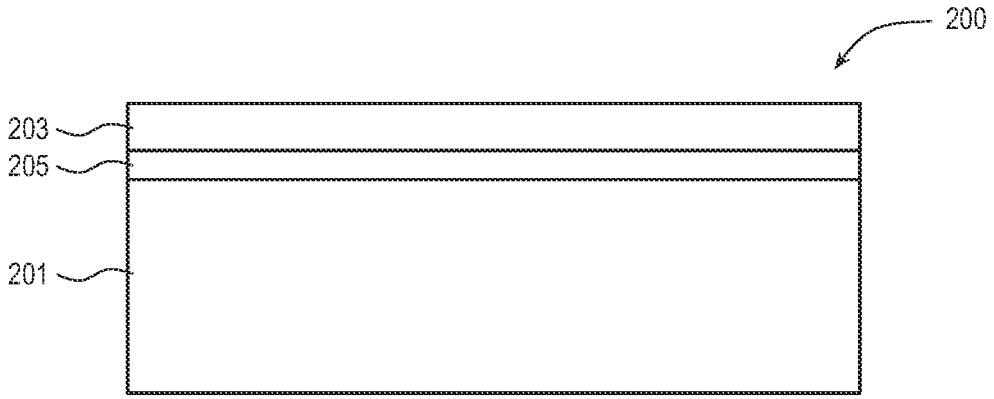
FIG. 3 shows a side view of an assembled floor panel.

The base tiles 202 are shown as a square, however, other shapes are possible (e.g., triangle, rectangle, pentagon, hexagon, circular, ellipsoidal etc.). In some examples, the base tiles 202 can be approximately 18×18 inches. In some examples, the base tiles 202 can comprise a width of between 16 and 20 inches, and a length of between 16 and 20 inches. The completed floor panel can be approximately 36×36 inches, but can also be of any suitable size as required by the particular area of floor being covered by the completed floor panel FIG. 3 shows a side view of the floor panel 200 according to one embodiment. As described herein, the floor panel can include a base layer 201, a top layer 203, and an adhesive layer that secures the base layer 201 to the top layer. In some examples, the top layer 203 is secured to the base layer 201 using a dual-sided, adhesive-backed panel 205, although adhesive of any suitable composition may be used. The adhesive 205 can be applied to one side of the base layer 201 before applying the top layer 203 to the base layer 201. In some examples, the adhesive 205 is applied to the top layer 203. In some examples, the adhesive 205 is applied to both the top layer 203 and the base layer 201.

The adhesive 205 can be applied using roller coaters. For example, the top layer 203 and/or the base layer 201 can fed through a device that applies the adhesive 205 to one side of the layer. The adhesive 205 can include any glue or epoxy suitable to secure the top layer to the bottom layer. The present disclosure contemplates alternative forms of securing the top layer to the base layer, such as mechanical fasteners.

Figure 4:
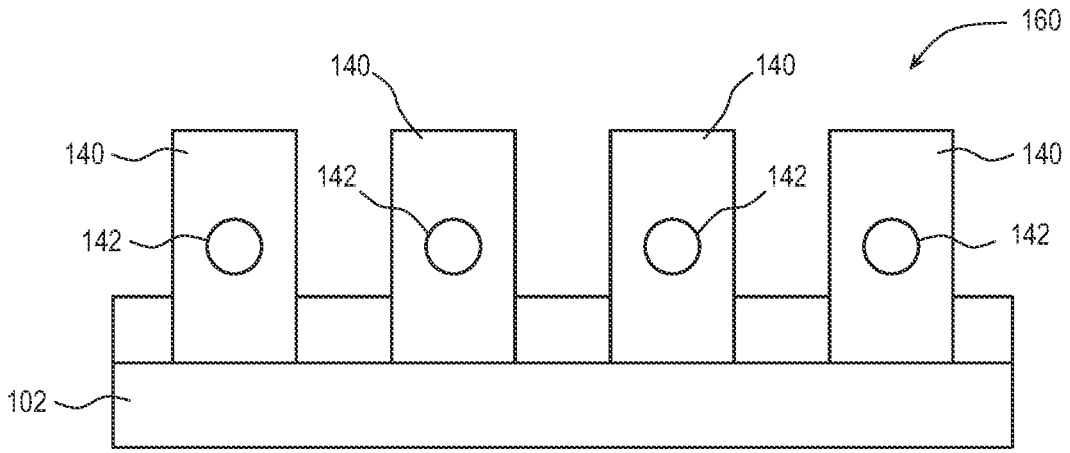
FIG. 4 shows a guide wall of a device for assembling a floor panel.

FIG. 4 shows a side view of a wall 160 on the platform 102. The wall 160 and platform 102 can be substantially similar to, including some or all of the features of the wall and platform described herein, the first wall 138 and the platform 102 of FIG. 1. The wall 160 can be positioned on the platform 102. The wall 160 can include guides 140 that extend above a first height of the wall 160. As described herein, as the top layer is being placed onto the base layer, the guides 140 can help align the edges of the top layer with the edges of the base layer. In some examples, the wall 160 can include sensors 142 that are configured to detect if and when the top layer is properly aligned with the base layer. The sensors 142 can be positioned on the guides 140. According to one embodiment, the sensors 142 can be pressure contact sensors capable of detecting if the top layer is in contact with one or more of the sensors 142. In some examples, the sensors 142 are optical sensors capable of determining the position of the top layer relative to the guides 140. For example, the sensors 142 can be laser alignment devices.

In some examples, the sensors 142 are operatively coupled to a processor that controls the couplers 116 and/or the movement of the support arm 104. In some examples, the processor does not allow the couplers 116 to release the top layer until the sensors 142 detect that the top layer is properly aligned with the base layer. In some examples, the processor restricts motion of the support arm 104 and/or retention feature 108 until it is determined by the sensors 142 that the top layer is properly aligned with the base layer. For example, the processor may prevent the retention feature 108 from lowering the top layer onto the base layer until the top layer is properly aligned with the base layer.

The assembly apparatus can include indicators configured to provide feedback to an operator of the assembly apparatus regarding the alignment status of the top layer relative to the bottom layer. The feedback from the indicator can be one or more of visual feedback, audible feedback, or tactile feedback. In some examples, the indicator includes a laser alignment device that allows the user to see when the top layer is properly aligned with the bottom layer based on the status of the laser.

Figure 5:
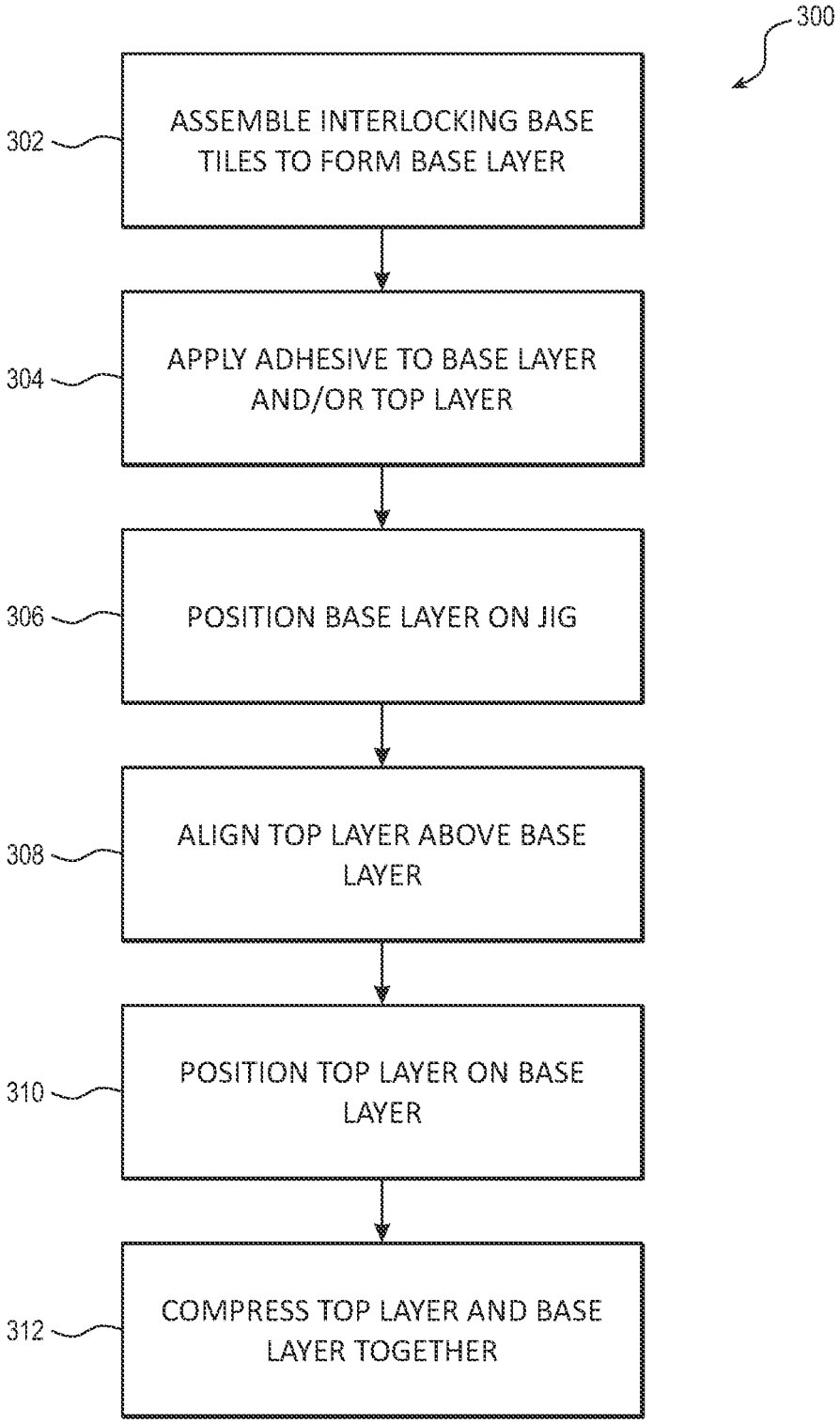
FIG. 5 shows a process flow diagram for assembling a floor panel.

FIG. 5 shows a process 300 for assembling a floor panel using the apparatus and methods described herein. At step 302, a base layer can be formed by connecting multiple section of interlocking base tiles together. This is illustrated and described in greater detail above with reference to FIGS. 2A and 2B.

At step, 304, an adhesive can be applied to the base layer and/or the top layer. The adhesive can be any suitable glue or epoxy for securing the top layer to the base layer. The adhesive can be applied to one side of the base layer before setting the top layer on the base layer. In some examples, the adhesive is applied to the top layer. In some examples, the adhesive is applied to both the top layer and the base layer before they are joined. The adhesive can be applied using roller coaters. For example, the top layer and/or the base layer can fed through a device that applies the adhesive to one side of the layer.

At step 306, the base layer can be positioned on the assembly apparatus (e.g., on the surface 128 between at least two of the walls, 138, 139, 132*a*, and 132*b*). An operator of the assembly apparatus can ensure that the base layer is positioned correctly on the platform by pushing the base layer against two of the guard walls. In some examples, the walls on the platform define a recess that the base layer can be set into. An indicator, such as a visual or audible signal can alert an operator if the base layer is not positioned properly on the platform. In some examples, the support arm will not operate to transport the top layer onto the base layer, if it is determined by sensors that the base layer is not properly positioned on the platform.

At step 308, the top layer can be aligned above the base layer, preparatory to affixing the top layer onto the base layer. Guides, such as the guides 140*a*, 140*b* of FIG. 1, can extend upward from one or more of the walls. The guides can extend taller than a thickness or height of the assembled panel. The extended height of the guides allows the top layer to come into contact with and be directed by the guides before the top layer is lowered onto the base layer. With two adjacent edges of the top layer contacting two adjacent walls, the position of the top layer is fixed relative to the base layer. Thus, the guides can ensure that the top layer is correctly aligned before lowering the top layer into place.

In some examples, the assembly apparatus can include an indicator that alerts an operator to the alignment status of the top layer relative to the base layer. For example, a visual indicator such as a laser alignment device can assist the operator is aligning the top layer with the bottom layer. In some examples, the assembly apparatus can include sensors that are configured to detect if and when the top layer is properly aligned with the base layer. The assembly apparatus can include a plurality of sensors, such as pressure contact sensor and optical sensors capable of determining an alignment of the top layer relative to the guides and/or the base layer. In some examples, placement of the top layer onto the base layer is prevented if it is determined by a processor that the top layer is out of alignment with the base layer.

At step 310, upon determining, either by an operator using the tactile and visual indicators or by alignment sensors, that the top layer is properly aligned with the base layer, the top layer is placed onto the base layer. As used herein, properly aligned can refer to each edge of the top layer vertically aligning with a corresponding edge of the base layer. Once the top layer is set onto the base layer, the support art can release the top layer. The top layer can then be secured to the base layer using an adhesive or any suitable securement mechanism, including but not limited to fasteners and magnets. In some examples, the support arm can set the top layer on the base layer, and also can further apply a downward force to the top layer to aid in securing the top layer to the base layer. For example, the support arm can press the top layer onto the base layer in order to activate a pressure sensitive adhesive. In some examples, upon coupling the top layer to the base layer to form a completed floor panel, one or more walls of the assembly apparatus can be repositioned in order to remove the floor panel from the assembly apparatus. Upon coupling the top layer to the base layer to form a completed floor panel, the support arm can be used to move the floor panel off of the platform and to a new location.

Figure 6:
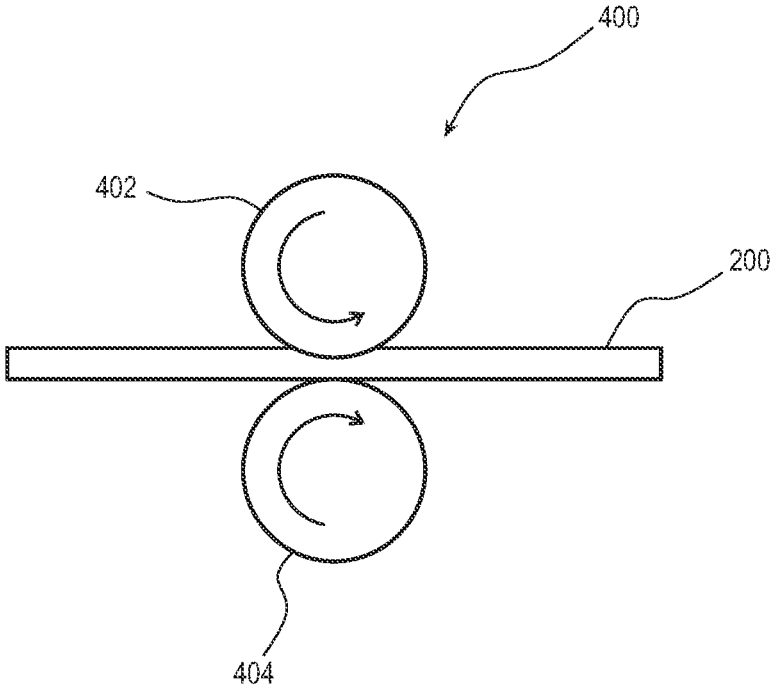
FIG. 6 shows a side view of a floor panel being compressed.

At step 312, the assembled floor panel can be compressed by pressing the top layer and the base layer together. This embodiment is shown in FIG. 6. Compression of the floor panel can aid in securing the top layer to the base layer. As discussed above, the adhesive between the top layer and the base layer can be a pressure sensitive adhesive (PSA). Thus, after positioning the top layer onto the base layer, the PSA can be activated by compressing the top layer and base layer together. As illustrated in FIG. 6, the floor panel can be sent through a roll press. In some examples, the ambient temperature and the temperature of the adhesive can be regulated to ensure optimal performance of the adhesive. For example, the ambient temperature may be kept between 60 and 85 degrees Fahrenheit. One or more of the device used in the process 300 can include temperature sensors. If it is determined that the temperature is too hot or too cold to properly adhere the top layer to the bottom layer, the process can be suspended.

FIG. 6 shows a side view of the floor panel 200 passing through a compression apparatus 400. As discuss above, compression of the assembled floor panel 200 can assist in activating the adhesive and further securing the top layer to the base layer. The compression apparatus 400 can be a roll press, including a first roller 402 and a second roller 404. The first roller 402 and the second roller 404 can be configured to rotate is opposite directions. For example, the first roller 402 can rotate counter-clockwise and the second roller 404 can rotate clockwise, such that as the floor panel 200 is inserted into the compression apparatus 400, the floor panel 200 is pulled or fed through the compression apparatus 400. The floor panel 200 can be fed through the compression apparatus 400 in a variety of orientations. In some examples, the assembled floor panel 200 can be transferred from the assembly apparatus 100 to the compression apparatus 400 using the support arm 104. In some examples, the compression apparatus 400 is integrally formed or combined with the assembly apparatus 100, forming a unitary apparatus.

The first roller 402 can be spaced a predetermined distance from the second roller. The predetermined distance can be slightly less than a thickness of the assembled floor panel 200 such that as the floor panel 200 passes between the first roller 402 and the second roller 404, the floor panel is squeezed or compressed between the first roller 402 and the second roller 404. The present disclosure contemplates alternative compression mechanisms or presses that are capable of compressing the floor panel 200. For example, the floor panel 200 can be compressed by a linear press (e.g., a hydraulic press).

While the present disclosure relates to a top layer and a base layer, it will be understood by those of ordinary skill in the art in view of this disclosure that additional layers between the base layer and the top layer may be used in assembling a completed floor panel according to the present disclosure. Furthermore, those of ordinary skill in the art in view of this disclosure will understand that the top layer and the base layer can be reversed. In other words, the "top" layer, intended to be an upper surface of the floor panel, can be first set onto the assembly apparatus and the "base" layer, intended to contact the floor, can be transported by the support arm and placed onto the "top" layer.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including" and "having" come as used in the specification and claims shall have the same meaning as the term "comprising."

The invention claimed is:

1. An assembly apparatus for assembling a floor panel, the assembly apparatus comprising:

a platform configured to support a base layer and a top layer of the floor panel, the platform comprising:

a first wall configured to contact a first edge of the base layer and a first edge of the top layer; and a second wall adjacent to the first wall and configured to contact a second edge of the base layer and a second edge of the top layer;

a plurality of fixed guides positionally set along at least one of the first wall or the second wall; and a sensor unit configured to determine whether the first edge of the base layer is aligned with the first edge of the top layer, and whether the second edge of the base layer is aligned with the second edge of the top layer, wherein the sensor unit is positionally fixed relative to the platform at a location corresponding to at least one of the first wall, the second wall, or a fixed guide of the plurality of fixed guides.

2. The assembly apparatus of claim 1, further comprising:

a transfer mechanism configured to move the top layer, the transfer mechanism comprising a retention feature configured to releasably secure the top layer to the transfer mechanism.

3. The assembly apparatus of claim 2, wherein the transfer mechanism comprises an articulating vacuum arm.

4. The assembly apparatus of claim 3, wherein the retention feature comprises a plurality of suctioning couplers.

5. The assembly apparatus of claim 2, wherein the transfer mechanism is configured to perform an action in response to a determination of the sensor.

6. The assembly apparatus of claim 1, wherein each of the first wall and the second wall comprise the plurality of fixed guides, each fixed guide of the plurality of fixed guides extending from the wall and configured to contact and guide the top layer onto the base layer.

7. The assembly apparatus of claim 1, wherein the first wall and the second wall define a plurality of recesses configured to receive protrusions extending from the first edge and the second edge of the base layer, respectively.

8. The assembly apparatus of claim 1, further comprising a third wall configured to contact a third edge of the base layer, the third wall defining a plurality of recesses configured to receive protrusions on the third edge.

9. The assembly apparatus of claim 8, further comprising a fourth wall configured to contact a fourth edge of the base layer, the fourth wall defining a plurality of recesses configured to receive protrusions on the fourth edge.

10. The assembly apparatus of claim 1, wherein the sensor unit comprises a visual indicator configured to signal to an operator an alignment of the top layer relative to the base layer.

11. The assembly apparatus of claim 1, wherein the sensor unit comprises one or more laser sensors.

12. The assembly apparatus of claim 1, wherein the sensor unit comprises:

a first pressure sensor on the first wall, the first pressure sensor configured to detect contact between the first wall and the first edge of the top layer; and a second pressure sensor on the second wall, the second pressure sensor configured to detect contact between the second wall and the second edge of the top layer.

13. A method for assembling a tile, the method comprising:

positioning a first edge of a base layer against a first wall;

positioning a second edge of the base layer against a second wall, the second edge being adjacent to the first edge;

lowering a top layer toward the base layer and causing the top layer to contact a plurality of fixed guides extending upward from at least one of the first wall or the second wall, wherein in response to contacting the plurality of fixed guides while lowering the top layer:

a first side of the top layer is positioned against the first wall; and a second side of the top layer is positioned against the second wall, the second side being adjacent to the first side; and releasing the top layer onto the base layer.

14. The method of claim 13, further comprising forming the base layer from multiple interlocking base tiles.

15. The method of claim 13, further comprising depositing an adhesive on at least one of the base layer and the top layer.

16. The method of claim 15, further comprising compressing the top layer to the base layer.

17. The method of claim 13, further comprising restricting placement of the top layer on the base layer in response to determining that the top layer is not aligned with the base layer.

18. A system for assembling a floor panel, the system comprising:

an articulating arm;

a coupler attached to an end of the articulating arm, the coupler configured to releaseably couple to a top layer; and a platform comprising:

a stationary platform surface;

a wall disposed around the stationary platform surface and configured to position a base layer in a predetermined location on the stationary platform surface; and a plurality of fixed guides extending upward from the wall, the plurality of fixed guides configured to position the top layer in a predetermined location above the base layer as the articulating arm lowers the top layer toward the base layer.

19. The system of claim 18, wherein:

the wall is a first wall configured to contact a first edge of the base layer;

the plurality of fixed guides comprises a first fixed guide configured to contact a first edge of the top layer; and the system further comprise:

a second wall adjacent to the first wall and configured to contact a second edge of the base layer;

a second fixed guide of the plurality of fixed guides extending from the second wall, the second fixed guide of the plurality of fixed guides being configured to contact a second edge of the top layer; and a sensor unit configured to determine whether the first edge of the base layer is aligned with the first edge of the top layer, and whether the second edge of the base layer is aligned with the second edge of the top layer.

20. The system of claim 18, wherein a function of the articulating arm is restricted based on a position of the top layer relative to the base layer.

* * * * *